US010427062B2

(12) United States Patent
Lee

(10) Patent No.: US 10,427,062 B2
(45) Date of Patent: Oct. 1, 2019

(54) WHEEL ASSEMBLY FOR COUNTERING AN ACTING GRAVITATIONAL FORCE

(71) Applicant: MP Development Limited, Hong Kong (CN)

(72) Inventor: Kung Jui Lee, Hong Kong (CN)

(73) Assignee: MP Development Limited, Kowloon, Hong Kong (CN)

( * ) Notice: Subject to any disclaimer, the term of this patent is extended or adjusted under 35 U.S.C. 154(b) by 0 days.

(21) Appl. No.: 15/947,984

(22) Filed: Apr. 9, 2018

(65) Prior Publication Data

US 2018/0290066 A1 Oct. 11, 2018

(30) Foreign Application Priority Data

Apr. 11, 2017 (HK) ..... 17103693.5

(51) Int. Cl.
*A63H 17/26* (2006.01)
*A63H 17/25* (2006.01)
*A63H 17/36* (2006.01)

(52) U.S. Cl.
CPC ..... *A63H 17/262* (2013.01); *A63H 17/25* (2013.01); *A63H 17/36* (2013.01)

(58) Field of Classification Search
CPC ..... A63H 11/04; A63H 15/00; A63H 15/02; A63H 17/26; A63H 17/262
USPC ..... 446/431, 441, 445, 466
See application file for complete search history.

(56) References Cited

U.S. PATENT DOCUMENTS 2,618,889 A * 11/1952 Wigal ..... A63H 11/04 446/133
3,061,972 A * 11/1962 Wigal ..... A63H 17/004 446/177
3,810,515 A * 5/1974 Ingro ..... A63H 11/04 180/164
4,477,998 A * 10/1984 You ..... A63H 11/04 446/177
4,547,173 A 10/1985 Jaworski et al.
4,648,853 A 3/1987 Siegfried
4,764,148 A * 8/1988 Wong ..... A63H 15/00 446/289
4,892,503 A * 1/1990 Kumazawa ..... A63H 17/004 446/437
5,746,641 A * 5/1998 Wong ..... A63H 17/004 446/431
5,916,008 A * 6/1999 Wong ..... A63H 17/262 446/431
6,099,091 A * 8/2000 Campbell ..... B60B 15/18 152/209.17

(Continued)

FOREIGN PATENT DOCUMENTS

CN 1895712 A 1/2007
CN 200970474 Y 11/2007

(Continued)

OTHER PUBLICATIONS

SIPO Republic of China Search Report for Hong Kong Short-Term Patent Application No. HK17103693.5, dated Feb. 6, 2018.

*Primary Examiner* — Alexander R Niconovich
(74) *Attorney, Agent, or Firm* — Leydig, Voit & Mayer

(57) ABSTRACT

A wheel assembly for use on a toy car includes a roller defining an axis of rotation, a wheel portion connected to the roller. The periphery of the wheel portion an at least partially sticky surface, which includes a blank portion without a tendency to stick.

19 Claims, 3 Drawing Sheets

(56) References Cited

U.S. PATENT DOCUMENTS

| | | | | |
|---|---|---|---|---|
| 6,793,026 | B1 * | 9/2004 | De Fazio | A63H 11/04 180/8.3 |
| 6,890,240 | B2 * | 5/2005 | Chen | A63H 15/00 446/431 |
| 9,428,231 | B2 * | 8/2016 | Beard | B62D 55/02 |
| 9,956,491 | B2 * | 5/2018 | McCafferty | A63H 11/00 |
| 2008/0017433 | A1 * | 1/2008 | Taft | A63H 17/262 180/252 |
| 2008/0064294 | A1 * | 3/2008 | Wong | A63H 11/04 446/441 |

FOREIGN PATENT DOCUMENTS

| | | | |
|---|---|---|---|
| CN | 201299972 | Y | 9/2009 |
| CN | 104524784 | A | 4/2015 |

* cited by examiner 200
203A
203B
202
206
201

200
203A
203B
202
206
207
205
201
100

200
202
203A
203B
206
207
205
100

200
202
203A
203B
206
207
100

WHEEL ASSEMBLY FOR COUNTERING AN ACTING GRAVITATIONAL FORCE

The present invention relates to a wheel assembly for countering an acting gravitational force for use on a toy, for example particularly, but not exclusively, a toy car.

BACKGROUND OF THE INVENTION

Toys facilitated to run on vertical surfaces are known. For example, a wheeled toy with suction cups mounted on respective spokes of the wheel which uses a plurality of suction cups mounted on respective spokes of a wheel. The wheel is caused to rotate and the suction cups on each spoke sequentially stick to and lift off from the vertical surface to effect a walking action. The use of suction cup limits the texture of the playable vertical surface which has to be smooth in order for the suction cup to create a partial vacuum. The right amount of force has to be applied to press the suction cup against the surface and create an optimum suction force which can be overcome by the gravitational force acting on the toy to lift the suction cup. Too much force exerted initially by a child when placing the toy on the vertical surface would prevent the toy from running on the surface. The use of suction cups also limits the direction of movement available.

Another possible arrangement would be the use of magnetic rollers in a toy. The rollers are adhered to a vertical ferromagnetic surface and the weight of a toy under the action of gravitational force brings about rolling of the roller. This brings about the movement of the car on the surface. The playable area is very limited, as the surface on which the rollers run has to be magnetized. The direction of movement of the toy is guided or limited by the arrangement of Ferro magnets on the vertical surface.

The invention seeks to eliminate or at least to mitigate such shortcomings by providing a toy with a wheel assembly according to the invention.

SUMMARY OF THE INVENTION

In a first aspect of the invention there is provided a wheel assembly for use on a toy car, comprising a roller defining an axis of rotation, a wheel portion in connection with the roller, wherein periphery of the wheel portion is at least partially covered by a sticky surface, which includes a blank portion without a tendency to stick. Preferably, the blank portion comprises a portion of the periphery of the wheel portion which is devoid of the sticky surface. More preferably, the roller includes a shaft and two wheel portions, the wheel portions are provided about the shaft and rotatable by or with the roller. Advantageously, the two wheel portions are provided at opposite ends of the shaft. More advantageously, periphery of each of the two wheel portions is at least partially covered by a sticky surface. Yet more advantageously, the two wheel portions each having a periphery being at least partially covered by a sticky surface, which includes a blank portion without a tendency to stick. Preferably, the blank portion comprises a portion of the periphery of the wheel portion which is devoid of the sticky surface. More preferably, the blank portions of the wheel portions are arranged consecutively about the axis of rotation such that the sticky surface of one wheel portion is in physical. Yet more preferably, the blank portions of the wheel portions angularly overlap about the axis of rotation. It is preferable that the overlap is between 0 to 40 degree about the axis of rotation and along circumferential length of the wheel portion. Advantageously, the two wheel portions are connected through a bridge that extends therebetween and radially from the roller. More advantageously, the circumferential length of the overlap is substantially the same as circumferential length of the bridge. between the blank portions is substantially the same as width of the bridge. It is preferable that the sticky surface is an undulated sticky surface.

In a second aspect of the invention there is provided a toy installed with the wheel assembly as detailed above. Preferably, the toy includes a housing with a bottom side having an opening, the wheel assembly is movable between an operating position where the wheel assembly extends beyond the housing through the opening and a non-operating position in which the wheel assembly is stowed in the housing behind the opening. More preferably, the wheel assembly is pivotally attached to the housing and movable between the operating and non-operating position through pivotal action.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1C:
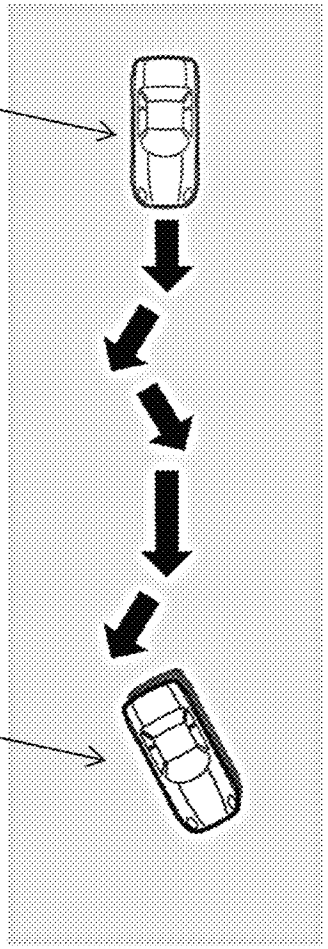
FIG. 1C is an illustrative drawing showing pattern of movement of the toy car on the vertical surface in FIGS. 2A-2D.
Figure 1B:
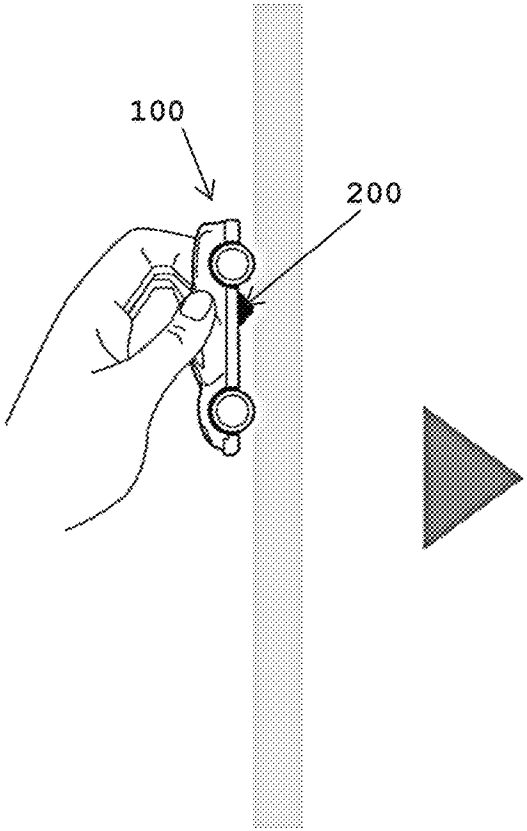
FIG. 1B is an illustrative view of the toy car in FIG. 1A being placed on a vertical surface.
Figure 1A:
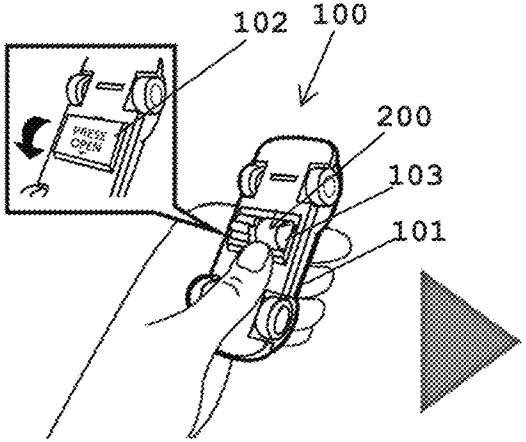
FIG. 1A is an illustrative bottom view of a toy car installed with a wheel assembly in accordance with the invention.
Figures 2A, 2B, 2C, 2D:
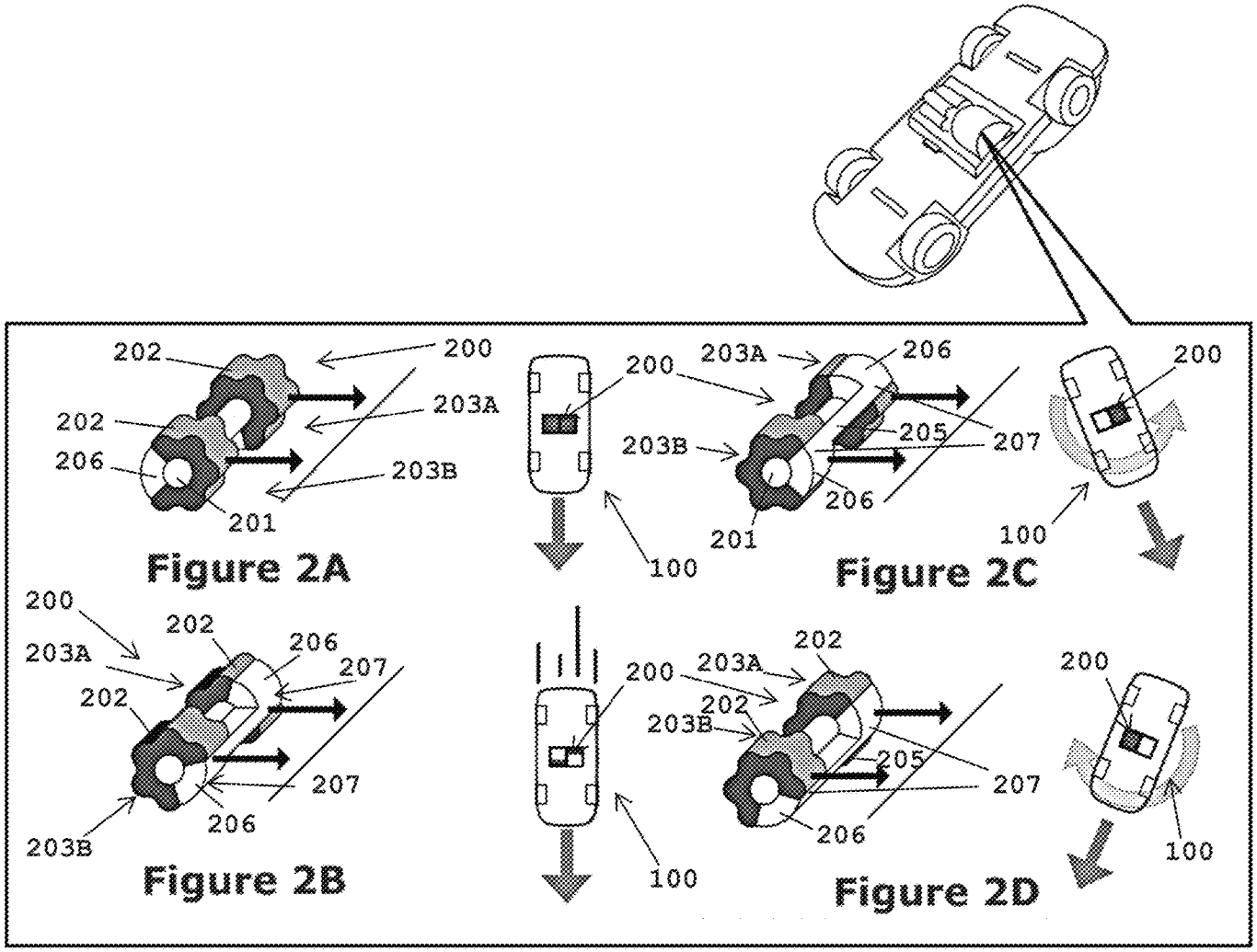
FIGS. 2A, 2B, 2C and 2D are illustrative drawings showing the relationship between the states of the wheel assembly to the patterns of movement.
Figure 4A:
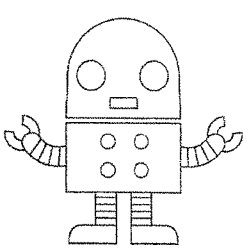
FIGS. 4A and 4B are illustrative drawings showing pattern of movement of two of the toys in FIG. 3 on a vertical surface.
Figure 4A:
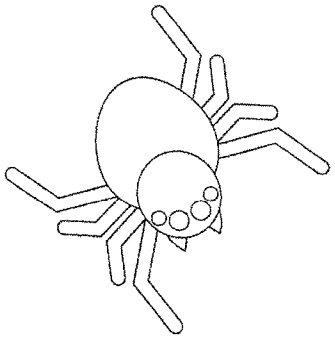
Figure 4B:
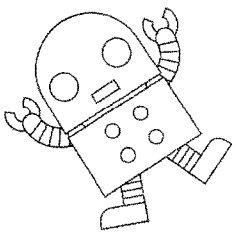
Figure 4B:
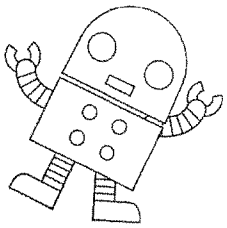

Referring to FIGS. 1A, 1B, 2A, 2B, 2C and 2D, there is shown a toy car 100 installed with a wheel assembly 200 in accordance with the invention. Instead of a toy car, toys with different external appearances are shown as examples in FIG. 3.

The toy 100 defines a housing 101 in which the wheel assembly 200 is installed. The wheel assembly 200 includes a roller 201 partly coated with an undulated sticky peripheral surface 202. The roller 201 defines an axis of rotation and is movable from a non-operating position to an operating position. In the non-operating position, the roller 201 is stowed wholly inside of the housing 101 and in the operating position, part of the roller 201 and a respective part of the sticky peripheral surface 202 extend out of the housing 101 and being exposed.

In more detail, the roller 201 is in connection with a pivotable bracket 102 which can be pivoted between open and closed positions. In the open position, the roller 201 is exposed and being moved to its operating position. At the closed position, the cover conceals the roller 201. The roller 201 is supported by the pivotal bracket 102 which provides a rectangular cover for an opening 103 at the bottom of the toy car 100. The roller 201 reaches the operating position by extending through the opening 103. The pivotal action of the bracket 102 is constrained by a stopper (not shown).

Referring to FIG. 1C, the toy car is designed to move in a non-straight pattern, for example, a zig zag pattern, over a vertical surface. This is made possible by the arrangement of the undulated sticky peripheral surface 202 on the roller 201.

Looking at FIGS. 2A, 2B, 2C, and 2D, the roller 201 includes two wheel portions 203A and 203B provided at opposite ends of a center shaft 204. Diameters of the wheel portions 203A and 203B are about double the diameter of the center shaft 204. The two wheel portions 203A and 203B are connected through a bridge 205 in the form of a plate extending radially from the shaft 204 and between the two wheel portions 203A and 203B. The outer side of the bridge 205 is flush with parts of the peripheral surfaces of the wheel portions 203A and 203B. The sticky peripheral surfaces 202 are located on first parts of the peripheral surfaces of the wheel portions 203A and 203B and extend along ¾ of the peripheral surfaces of the wheel portions 203A and 203B, leaving a gap in each of the sticky peripheral surfaces 202 of the wheel portions 203A and 203B of about ¼ of the circumferences of the wheel portions 203A and 203B, and along the full width of the bridge 205. Each gap in each of the sticky peripheral surfaces 202 adjoins a blank portion 206, i.e., second part of the peripheral surfaces of the wheel portions 203A and 203B so that, as shown in FIGS. 2A, 2B, 2C, and 2D, the peripheral surfaces of the two wheel portions 203A and 203B extend entirely around the axis of rotation X. Each blank portion 206 of the peripheral surfaces of the wheel portions 203A and 203B is without a tendency to stick. In the preferred embodiment, each blank portion 206 of the peripheral surfaces of the wheel portions 203A and 203B is devoid of the stickiness of the sticky surface 202. The two blank portions 206 on the respective wheel portions 203A and 203B are provided consecutively, about the axis of rotation X, but with a brief angular overlap 207 about the axis of rotation X. In the preferred embodiment, the angular overlap 207 is between 0 to 40 degree about the axis of rotation X and along the circumference of the wheel portions 203A and 203B. The circumferential overlap 207 is substantially the same as circumferential length of the bridge 205 which extends between the blank portions 206 on the peripheral surfaces of the wheel portions 203A and 203B.

In an alternative embodiment, the sticky surface 202 may cover the entire periphery of the wheel portion, which has a blank portion that is without tendency to stick.

Generally, as the roller 201 travels along the vertical surface, the sticky peripheral surface 202 of the two wheel portions 203A and 203B grips onto the vertical surface. When reaching the first blank portion 206 on the wheel portion 20A, the gripping is maintained by the sticky peripheral surface 202 of wheel portion 203B. This brings about drifting of the toy car 100 in a first direction towards the wheel portion 203B. Upon reaching the bridge 205 and the brief overlap 207, the toy car moves straight ahead by the action of gravity. As the overlap 207 is brief, the re-gripping by the sticky surface 202 on the wheel portion 203A is fast enough to avoid falling of the toy car 100 off the vertical surface. Upon reaching the blank portion 206 on the wheel portion 203B, gripping onto the vertical surface is shifted from the wheel portion 203B to the wheel portion 203A. This causes the toy car 100 to drift in a second direction towards the wheel portion 203A. As a result, the toy car 100 is caused to move in a zig-zag pattern.

When the wheel assembly 200 is retracted to its stowed/non-operating position with the cover in its closed position, the toy car 100 is supported on four ordinary wheels allowing the toy car 100 to negotiate through a horizontal surface in a way common to conventional toy cars.

Figure 3:
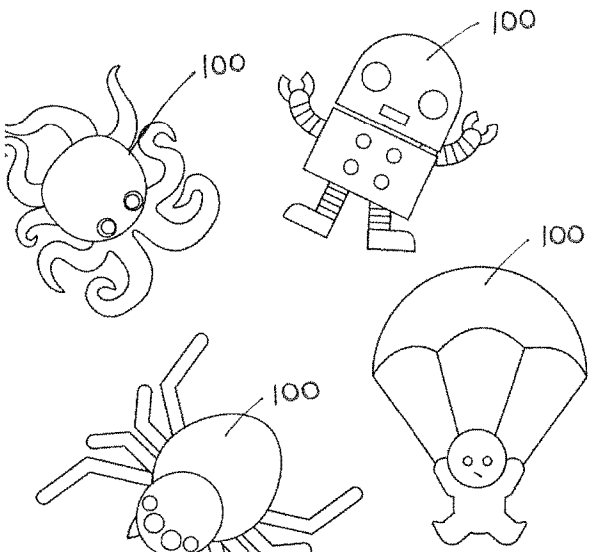
FIG. 3 is an illustrative drawing showing other examples of toys installed with the wheel assembly.

The toy 100 may take a different outlook as shown in FIG. 3.

The invention has been given by way of example only, and various other modifications of and/or alterations to the described embodiment may be made by persons skilled in the art without departing from the scope of the invention as specified in the appended claims.

The invention claimed is:

1. A wheel assembly for use on a toy car, the wheel assembly comprising:
- a roller defining an axis of rotation, and
- a wheel portion connected to the roller, wherein
  - the wheel portion has a peripheral surface that extends entirely around the axis of rotation, and
  - the peripheral surface of the wheel portion has a sticky portion that has a sticky surface, and a blank portion adjoining the sticky portion and that is devoid of the sticky surface.

2. The wheel assembly as claimed in claim 1, wherein
- the roller includes a shaft and two of the wheel portions,
- each of the two wheel portions includes a peripheral surface with a sticky portion and a blank portion, and
- the two wheel portions are located about the shaft and rotate upon rotation of the roller.

3. The wheel assembly as claimed in claim 2, wherein the two wheel portions are located at opposite ends of the shaft.

4. The wheel assembly as claimed in claim 3, including a bridge that extends between the two wheel portions and radially from the roller, wherein the two wheel portions are connected through the bridge.

5. The wheel assembly as claimed in claim 2, wherein the blank portions of the peripheral surfaces of the two wheel portions are arranged consecutively about the axis of rotation.

6. The wheel assembly as claimed in claim 2, wherein the blank portions of the peripheral surfaces of the two wheel portions have an angular overlap about the axis of rotation.

7. The wheel assembly as claimed in claim 6, wherein the angular overlap is up to 40 degrees, about the axis of rotation and along a circumference of the peripheral surfaces of the two wheel portions.

8. The wheel assembly as claimed in claim 7, including a bridge that extends between the two wheel portions and radially from the roller, wherein the two wheel portions are connected through the bridge.

9. The wheel assembly as claimed in claim 8, wherein the angular overlap has a length on the peripheral surfaces of the two wheel portions that is substantially the same as a circumferential length of the bridge.

10. The wheel assembly as claimed in claim 9, wherein the blank portions of the peripheral surfaces of the two wheel portions adjoin respective end portions of the bridge.

11. The wheel assembly as claimed in claim 1, wherein the sticky surface is a radially undulating sticky surface.

12. A toy including the wheel assembly as claimed in claim 1.

13. The toy as claimed in claim 12, wherein the toy includes a housing with a bottom side having an opening, the wheel assembly is movable between an operating position in which the wheel assembly extends beyond the housing through the opening, and a non-operating position in which the wheel assembly is stowed in the housing, behind the opening.

14. The toy as claimed in claim 13, wherein the wheel assembly is pivotally attached to the housing and is movable between the operating position and the non-operating position through pivotal action.

15. A wheel assembly for a toy car, the wheel assembly comprising:

a roller having an axis of rotation;

a first wheel portion having a peripheral surface that extends entirely around the axis of rotation, wherein the first wheel portion projects radially outward with respect to the axis of rotation, the peripheral surface of the first wheel portion includes a first circumferential portion having a peripheral outer surface extending partially around the peripheral surface of the first wheel portion and that is sticky, and a second circumferential portion having a peripheral outer surface extending partially around the peripheral surface of the first wheel portion and that is devoid of the sticky surface, wherein the first and second circumferential portions of the first wheel portion adjoin each other and extend entirely around the axis of rotation; and a second wheel portion having a peripheral surface that extends entirely around the axis of rotation, wherein the second wheel portion projects radially outward with respect to the axis of rotation, the peripheral surface of the second wheel portion includes a first circumferential portion having a peripheral outer surface extending partially around the peripheral surface of the second wheel portion and that is sticky, and a second circumferential portion having a peripheral outer surface extending partially around the peripheral surface of the second wheel portion and that is devoid of the sticky surface, wherein the first and second circumferential portions of the second wheel portion adjoin each other and extend entirely around the axis of rotation, the first and second wheel portions are spaced apart on the roller, and the first and second wheel portions rotate upon rotation of the roller.

16. The wheel assembly as claimed in claim 15, wherein the first and second circumferential portions of the first and second wheel portions are arranged consecutively about the axis of rotation.

17. The wheel assembly as claimed in claim 15, wherein the first and second circumferential portions of the first and second wheel portions have an angular overlap about the axis of rotation.

18. The wheel assembly as claimed in claim 15, wherein the peripheral surfaces of the first circumferential portions of each of the first and second wheel portions are radially undulating with respect to the axis of rotation.

19. The wheel assembly as claimed in claim 15, including a bridge that extends between the first and second wheel portions and radially outward from the axis of rotation, wherein the first and second wheel portions are connected to each other by the bridge.

* * * * *